US009636696B2

(12) United States Patent
Hextall

(10) Patent No.: US 9,636,696 B2
(45) Date of Patent: May 2, 2017

(54) BOTTLE CAP

(71) Applicant: Toby Hextall, London Greater London (GB)

(72) Inventor: Toby Hextall, London Greater London (GB)

( * ) Notice: Subject to any disclaimer, the term of this patent is extended or adjusted under 35 U.S.C. 154(b) by 0 days.

(21) Appl. No.: 15/025,922

(22) PCT Filed: Oct. 1, 2014

(86) PCT No.: PCT/IB2014/065001

§ 371 (c)(1),
(2) Date: Mar. 30, 2016

(87) PCT Pub. No.: WO2015/052620

PCT Pub. Date: Apr. 16, 2015

(65) Prior Publication Data

US 2016/0214125 A1 Jul. 28, 2016

(30) Foreign Application Priority Data

Oct. 7, 2013 (GB) ..... 1317686.2

(51) Int. Cl.

| | |
|---|---|
| ***B05B 15/00*** | (2006.01) |
| ***B05B 11/00*** | (2006.01) |
| ***B05B 1/16*** | (2006.01) |
| ***B65D 41/04*** | (2006.01) |
| ***B65D 47/08*** | (2006.01) |

(52) U.S. Cl.

CPC ..... *B05B 11/0086* (2013.01); *B05B 1/16* (2013.01); *B05B 1/1627* (2013.01); *B05B 11/3011* (2013.01); *B05B 15/00* (2013.01); *B65D 41/04* (2013.01); *B65D 47/08* (2013.01)

(58) Field of Classification Search

CPC . B05B 11/0086; B05B 15/00; B05B 11/3011; B05B 1/16; B05B 1/1627; B65D 41/04; B65D 47/08

USPC ..... 239/333, 289, 436, 443, 447

See application file for complete search history.

(56) References Cited

U.S. PATENT DOCUMENTS 4,932,563 A * 6/1990 Diamond ..... A45F 3/16 239/289
6,161,777 A * 12/2000 Carter ..... A45F 3/16 239/289
2012/0267400 A1* 10/2012 Mohr ..... B05B 11/001 222/331

FOREIGN PATENT DOCUMENTS

GB 2448549 A * 10/2008 ..... B65D 1/32
WO WO 2004026706 A2 * 4/2004 ..... B05B 11/0086

* cited by examiner

*Primary Examiner* — Steven J Ganey
(74) *Attorney, Agent, or Firm* — Maine Cernota & Rardin

(57) ABSTRACT

A bottle cap 1 for closing the top of a bottle and providing either a stream of fluid through the bottle cap 1 or a spray mist, the bottle cap 1 having a cap body 2 that forms a fluid flow passage between a bottle end 3 that mates with a bottle and a dispensing end 4 through which a fluid stream can exit; an atomizer 5 mounted in the cap body 2, the atomizer 5 having an inlet passage 6 that extends towards the bottle end 3 and an outlet nozzle 7 that extends through the bottle cap 1; the cap body 2 and atomizer 5 sized and arranged so that fluid can flow from the bottle end 3 to the dispensing end 4 around the atomizer.

11 Claims, 3 Drawing Sheets

BOTTLE CAP

RELATED APPLICATIONS

This application is a national phase application filed under 35 USC §371 of PCT Application No. PCT/IB2014/065001 with an international filing date of Oct. 1, 2014, which claims priority to GB1317686.2, filed Oct. 7, 2013. Each of these applications is herein incorporated by reference in their entirety for all purposes.

FIELD OF THE INVENTION

The present invention relates to a bottle cap. More particularly, the present invention relates to a bottle cap that can dispense a fluid stream and an atomised fluid mist from a bottle to which it is connected.

BACKGROUND

It is common for people participating in sports to carry a drink or water bottle with them to help them to cool down and to rehydrate after exertion. Drinking bottles usually have a dispensing cap that provides a stream of water to a user when required. A user will normally drink either directly from the bottle or will pour the contents into a cup or similar. A user may also pour the contents of the bottle over their head or clothing to help cool them down and refresh them. When a user pours a stream of water over themselves, this tends to be inaccurate enough to soak certain areas while leaving others dry, and to cause a lot of spillage and mess on an around the user. This may not be an issue for sports participants where mess and spillage are not a concern, but it not ideal for people who may wish to cool down by dispensing fluids in a more controlled manner that does not completely soak the targeted area, and who may wish to lightly moisten a certain targeted area only.

PRIOR ART

Accordingly a number of patent applications have been filed in an attempt to resolve the problem or similar, including the following:

US2012/0267400 describes and shows a cap for water bottles that has a drinking spout and a mist sprayer.

US2011/0180630 describes and shows a spray bottle for normal drinking as well as spray drinking of water by squeezing the bottle body to increase the pressure inside the bottle. The bottle can also be held upside down and squeezed to produce a spray.

GB2448549 describes and shows a drinks container for sports use comprising a closure having a drinking outlet which is closed by a tubular valve member that surrounds an upstanding atomising nozzle. In use, water can be drunk from the container in the normal way by opening the valve member. Water can also be dispensed from the container via the atomising nozzle, which forms a cooling or refreshing spray.

It is an object of the present invention to provide a bottle cap which goes some way to overcoming the abovementioned disadvantages or which at least provides the public or industry with a useful choice.

SUMMARY OF THE INVENTION

Accordingly, in an aspect the present invention consists of a bottle cap, comprising: a cap body that forms a fluid flow passage between a bottle end, which end adapted to mate with a bottle, and a dispensing end; an atomiser mounted in the cap body, having an inlet passage that extends towards the bottle end and an outlet nozzle that extends through the cap; the cap body and atomiser sized and arranged so that fluid can flow from the bottle end to the dispensing end around the atomiser.

By forming the cap body and atomiser so that there is space around the atomiser for the fluid to flow the space within the cap is used effectively and the need for a separate drinking straw as well as an atomiser is negated.

In some embodiments, the outlet nozzle is formed to extend through the cap body at a position located remotely from the dispensing end. This allows a user to drink directly from the dispensing end without touching the outlet nozzle, which helps to keep the outlet nozzle clean.

In some embodiments, the cap body comprises first and second relatively moveable mated sections, movement of the first section towards the second section along a central axis through the cap body triggering a spray from the atomiser. This allows the atomiser to be used and triggered by moving one section of the cap relative to another section.

In some embodiments, the first section is coaxial with and at least partly nested within the second section. This allows a pump atomiser to be used and triggered or activated by pressing on the cap when it is connected to a bottle.

In some embodiments, the inlet passage is located and aligned with the central axis. This allows the use of a pump atomiser with fluid being pumped along the inlet passage as the atomiser is activated or triggered.

In some embodiments, an atomiser feed straw is fluidically connected to the inlet passage and arranged so that when the bottle cap is connected to a bottle, the atomiser feed straw will extend into the bottle. This allows the use of bottles of different lengths or depths with a single bottle cap, the length of the straw chosen for the bottle, but the rest of the cap remaining unchanged. This allows for economies of scale when manufacturing.

In some embodiments, the first and second sections can be relatively rotated around the axis between an unlocked position where the first and second sections are relatively axially moveable, and a locked position where the first and second sections cannot be relatively axially moved. This helps to prevent inadvertent triggering of the atomiser.

In some embodiments, the bottle end is internally threaded to mate with a bottle. Most bottles are externally screw-threaded to receive caps so this allows the bottle cap to be used with a large variety or range of bottles.

In some embodiments, the bottle cap further comprises a non-return valve co-located with the dispensing end. This helps to prevent water spillage when a user is not actively dispensing the contents of the bottle.

In some embodiments, the bottle cap further comprises a lid hingedly connected to the cap body that can be pivoted around the hinge connection to engage with the cap body to close the dispensing end. a lid can be used instead of or as well as a non-return valve to help prevent inadvertent contents dispensing or for increased hygiene.

In a second aspect, the invention may broadly be said to consist in a bottle for containing a volume of fluid, the bottle having a bottle cap for closing the bottle as outlined an any one of the preceding statements.

With respect to the above description then, it is to be realised that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

DETAILED DESCRIPTION

Figure 1A:
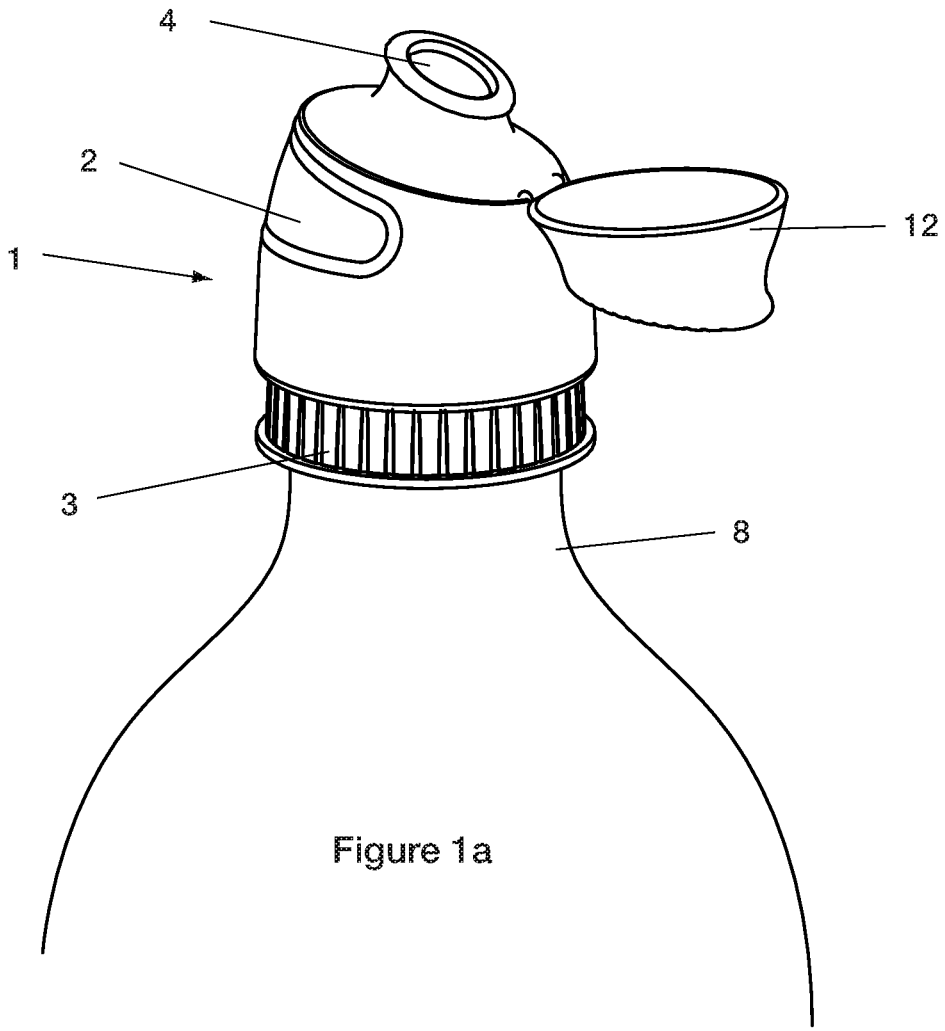
FIG. 1*a* shows a bottle cap according to an embodiment of the invention, having a cap body for connecting to a bottle, a dispensing end, a lid hingedly connected to the cap body so that it can be moved between an open and a closed position, the outer end of an outlet nozzle of an atomiser shown flush with the outer surface of the cap body.
Figure 1B:
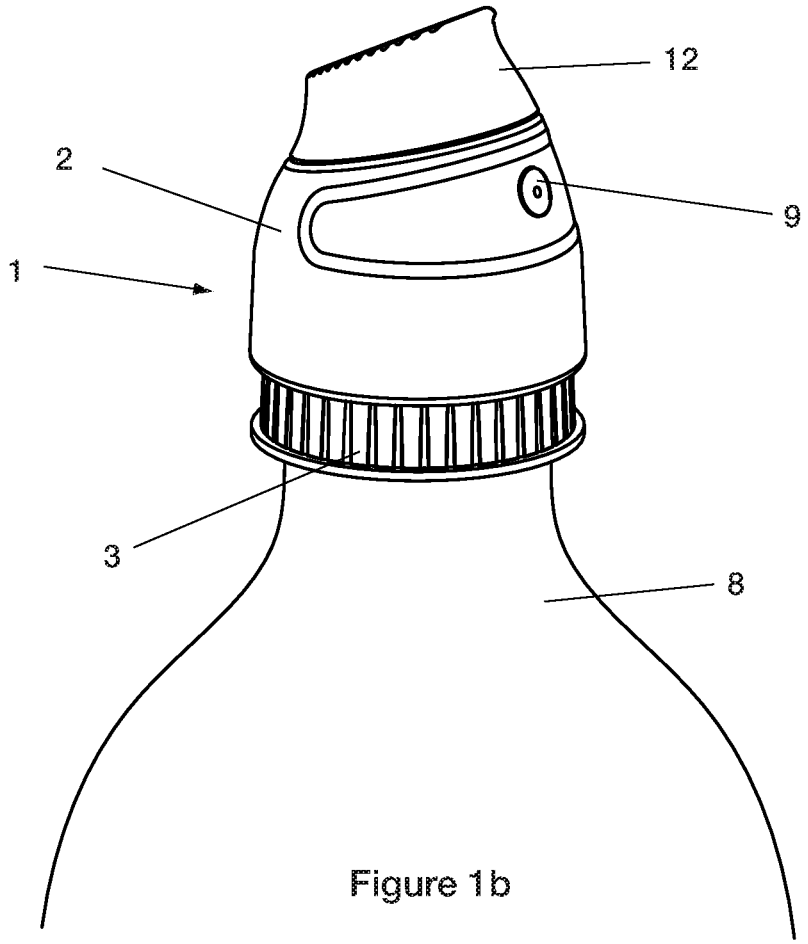
FIG. 1*b* shows the bottle cap of FIG. 1*a* with the lid closed
Figure 2:
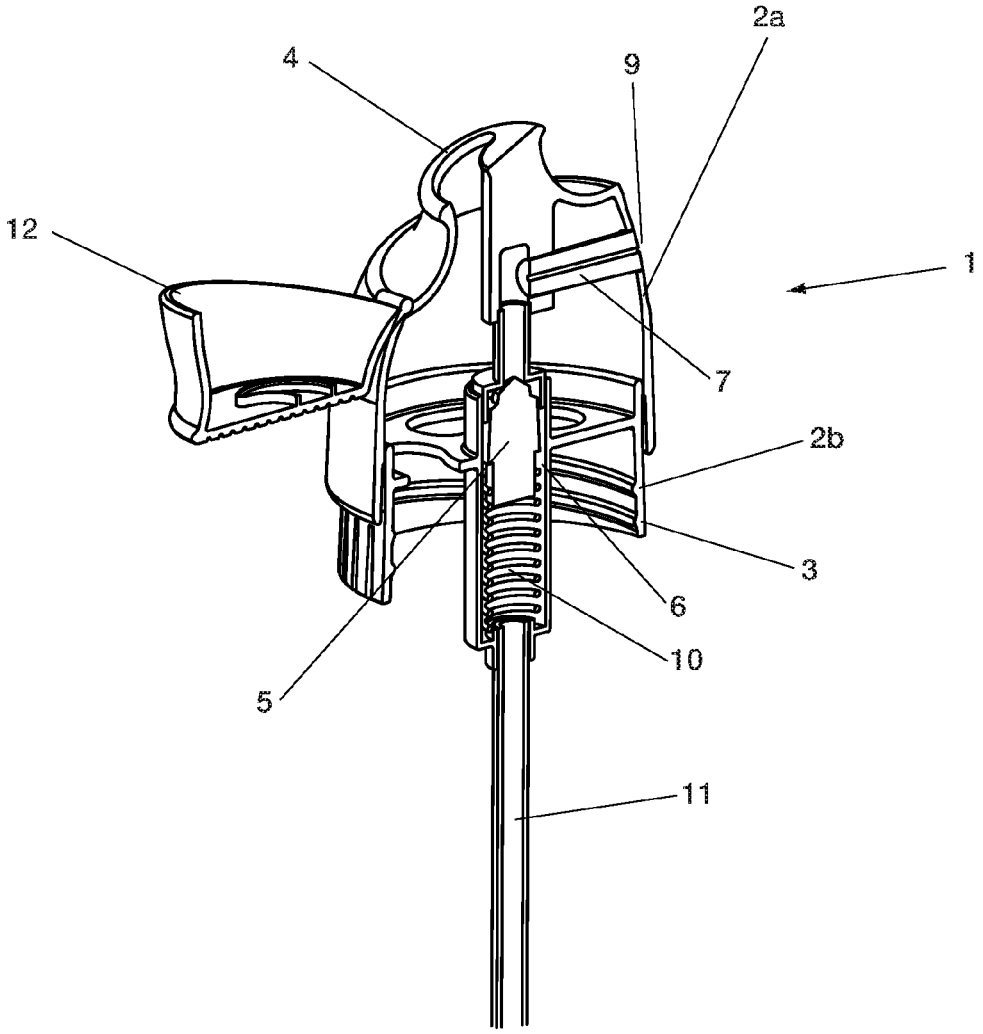
FIG. 2 shows a perspective cutaway view of the bottle cap of FIGS. 1*a* and 1*b*.

An embodiment of bottle cap 1 will now be described with reference to the figures, this embodiment suitable for use on a bottle such as a sports drink bottle, a water bottle or similar.

The bottle cap 1 has a cap body 2 that forms a fluid flow passage between a bottle end 3 and a dispensing end 4. The bottle end 3 of the cap body 2 has an internal screw thread so that the bottle cap 1 can be screwed onto a bottle having a matched external screw thread around the mouth of the bottle. The opposed end of the bottle cap 1 forms the dispensing end 4 through which a user can produce a stream of fluid from the contents of the connected bottle, the fluid passing out of the bottle through the bottle end 4, into the fluid flow passage formed by the cap body 2, and then through dispensing end 4.

An atomiser 5 is mounted in the cap body 2. The atomiser 5 has an inlet passage 6 that extends towards the bottle end 4, and an outlet nozzle 7 that extends through the bottle cap 1. That is, in this embodiment, the outlet nozzle 7 has an outer end 9 that passes through the wall of the cap body 2 so that the outer end 9 is substantially flush with the outer surface of the cap body. The atomiser 5 is used to produce a mist spray through the outlet nozzle 7. The source material for the atomiser is the contents of the bottle. The atomiser 5 in this embodiment is a pump atomiser that is manually pumped to produce a spray of mist with each individual pump action. Activation of the atomiser 5 and the manner in which the source material is provided to the atomiser 5 will be described in detail below.

The cap body 2 encloses a volume within which the atomiser 5 is located. The atomiser 5 and cap body 2 are sized and arranged so that fluid can flow through the cap body 2 from the bottle end 3 to the dispensing end 4 around the atomiser 5 without the progress of the fluid through the cap body 2 being significantly impeded by the atomiser 5—the fluid flows freely around the atomiser 5. This is an effective use of the space between the cap body 2 and the atomiser 5 and allows the bottle cap 1 to function as a combined dispensing bottle cap and atomised fluid sprayer, while at the same time removing the need for the cap 1 to have a drinking straw separate from the atomiser 5.

The cap body 2 is formed so that the bottle end 3 and the dispensing end 4 are substantially opposite one another. The outlet nozzle 7 is formed to extend through the cap body 2 partway along the side wall of the cap body 2. This ensures that the outer end 9 of the outlet nozzle exits the cap body 2 at a position located away from or remotely from the dispensing end 4. This is advantageous for a number of reason, including hygiene, as it allows a user to drink directly from the dispensing end 4 by placing this in their mouth, without touching the outlet nozzle 7, which helps to keep the outlet nozzle 7 clean.

In this embodiment, the cap body 2 is formed from two sections 2*a* and 2*b*. These will be referred to as first or upper section 2*a* and second or lower section 2*b* (for an upright bottle with the cap 1 screwed onto the top). Each of the sections 2*a* and 2*b* is substantially cylindrical. The second or lower section 2*b* is coaxial with the first section 2*a*, and is partly nested within the first section 2*a* as an interference fit. The sections are mated so as to be axially movable relative to one another and also rotatably movable relative to one another. Movement of the first section 2*a* towards the second section 2*b* along the central axis through the cap body 2—e.g. by a user pushing on the top of the cap body 2 to move the first section 2*a* towards the second section 2*b*—causes the a pumping action in the atomiser 5 and triggers a spray from the atomiser 5. The atomiser 5 has a return spring 10 which returns the two cap sections 2*a* and 2*b* to their original positions once a pump action is completed.

The inlet passage 6 of the atomiser 5 is located and aligned with the central axis of the cap body 2. Fluid is pumped along the inlet passage as the atomiser is activated or triggered. An atomiser feed straw 11 is connected to the end of the inlet passage 6 so that when the bottle cap 1 is connected to a bottle, the atomiser feed straw 11 will extend into the bottle. Atomiser feed straws of different lengths can be used, connected and disconnected as required e.g. by friction fit so that bottles of different lengths or depths can be used with a single design of bottle cap 1. The length of the straw 11 is chosen for the bottle, but the bottle cap otherwise remains the same.

As outlined above, the first and second sections can be relatively rotated around the axis. This allows the sections to be rotated between an unlocked position where the first and second sections 2*a*, 2*b* are relatively axially moveable, and a locked position where the first and second sections 2*a*, 2*b* cannot be relatively axially moved. In the locked position, the atomiser cannot be activated as with no axial movement the pump cannot function. This helps to prevent inadvertent triggering of the atomiser.

The dispensing end 4 of the cap body 2 can be fitted with a non-return valve so that fluid can exit the bottle but air cannot enter. This helps to prevent water spillage when a user is not actively dispensing the contents of the bottle. The bottle cap 1 can also be fitted with a lid 12 hingedly connected to the cap body 2, the lid 12 pivoting around the hinge connection with the cap body 2 between a closed position where the lid 12 is engaged with the cap body 2 to close the dispensing end, and an open position. The lid can be used instead of or as well as the non-return valve to help prevent inadvertent contents dispensing or for increased hygiene.

In use, a user can either drink directly from the bottle or pour out the contents as a stream by upending the bottle and either allowing gravity to pour out the contents or by squeezing the bottle (if it is a non-rigid bottle). A user can also pump the cap 1 to create an atomised mist which they can spray on themselves or other for cooling, cleaning or similar.

In variations of the embodiment described above, the screw thread fitting of the cap 1 could be replaced by a bayonet fitting, press fitting or similar. The outlet nozzle 7 in the embodiment above is located away from the dispensing end for improved hygiene, but these could also be co-located in if an embodiment requires this. The inlet passage and straw can be formed as separate items or as a single item. The inlet or bottle end 3 and the dispensing end 4 are located opposite one another axially in the embodiment described above. However, these could be located at an angle to one another. The atomiser described above is a pump atomiser with a single spray created for each axial pump. Any other suitable form of atomiser could also be used. It should also be noted that although in the embodiment described above, the cap 1 is used with a sports or drinking bottle, the cap 1 could also be used for bottle containing disinfectant, bleach, household cleaner or similar, where the dual action of a dispensing either a stream of liquid from a bottle or a spray mist might be advantageous. The bottle cap 1 could either be sold by itself, or as part of a bottle/cap combination.

The invention claimed is:

1. A bottle cap, comprising:

a cap body having a bottle end adapted to mate with a bottle and a dispensing end, the cap body defining a single fluid flow passage between the bottle end and the dispensing end thereof; and an atomiser mounted in the cap body, the atomizer having an atomizer inlet fluidly connected to the single fluid flow passage;

wherein the cap body comprises a first fluid outlet defined by the dispensing end thereof and a second fluid outlet, wherein the cap body is movable between a first configuration, in which liquid can flow from the bottle end of the cap body through the single fluid flow passage around the atomizer to the first fluid outlet, and a second configuration, in which liquid can flow through the single fluid flow passage from the bottle end of the cap body through the atomizer inlet at atomizer outlet to the second fluid outlet.

2. A bottle cap as claimed in claim 1 wherein the second outlet from the cap body is remote from the dispensing end thereof.

3. A bottle cap as claimed in claim 1 wherein the cap body comprises first and second relatively moveable mated sections, movement of the first section axially relative to the second section moves the cap body between the first configuration and the second configuration.

4. A bottle cap as claimed in claim 3 wherein the first section is coaxial with and at least partly nested within the second section.

5. A bottle cap as claimed in claim 3 further comprising an atomiser feed straw fluidically connected to the atomizer inlet and arranged so that when the bottle cap is mated with a bottle, the atomiser feed straw will extend into the bottle.

6. A bottle cap as claimed in claim 3 wherein the first and second sections can be relatively rotated around the axis between an unlocked position where the first and second sections are relatively axially moveable, and a locked position where the first and second sections cannot be relatively axially moved.

7. A bottle cap as claimed in claim 1 wherein the bottle end is internally threaded to mate with a bottle.

8. A bottle cap as claimed in claim 1 wherein the bottle cap further comprises a non-return valve co-located with the dispensing end of the bottle cap.

9. A bottle cap as claimed in claim 1 wherein the bottle cap further comprises a lid hingedly connected to the cap body that can be pivoted around the hinge connection to engage with the cap body to close the dispensing end.

10. A bottle for containing a volume of fluid, having a bottle cap for closing the bottle as claimed in claim 1.

11. A bottle cap according to claim 1, wherein the cap body is biased in the first configuration by a resilient member.

* * * * *